US007588217B1

(12) United States Patent
Rooker

(10) Patent No.: US 7,588,217 B1
(45) Date of Patent: Sep. 15, 2009

(54) SANDBAG FILLING TOOL

(76) Inventor: James M. Rooker, P.O. Box 1041, Plymouth, CA (US) 95669

( * ) Notice: Subject to any disclaimer, the term of this patent is extended or adjusted under 35 U.S.C. 154(b) by 348 days.

(21) Appl. No.: 11/474,201

(22) Filed: Jun. 23, 2006

(51) Int. Cl.
*B65B 67/12* (2006.01)

(52) U.S. Cl. ..... 248/95; 248/94

(58) Field of Classification Search ..... 248/94, 248/95, 99, 100, 247.1, 276.1, 282.1, 917, 248/919, 920, 922, 923; 361/681, 682
See application file for complete search history.

(56) References Cited

U.S. PATENT DOCUMENTS 3,060,536 A * 10/1962 La Voie ..... 24/346
4,324,125 A * 4/1982 Jarman et al. ..... 72/479
5,597,145 A * 1/1997 Meyers et al. ..... 248/97
6,047,748 A * 4/2000 Rooker ..... 141/391
6,116,548 A * 9/2000 Oleson ..... 248/97

* cited by examiner

*Primary Examiner*—J. Allen Shriver, II
*Assistant Examiner*—Erin Smith
(74) *Attorney, Agent, or Firm*—Heisler & Associates

(57) ABSTRACT

A tool is provided for filling sandbags in an efficient and easy manner, even with a single individual. The tool is in the form of a chute suspended above ground by a plurality of legs. The chute has a mouth at one side and a spout opposite the mouth. The mouth presents a large target into which sand can be placed. This sand then travels through the chute and exits through the spout. A sandbag is placed over the spout so that it captures sand exiting the chute. A fastener is provided, such as in the form of a clip, which removably attaches an opening of the sandbag over the spout. A ballast bag is provided which can be filled with sand and suspended from the chute to enhance the stability of the filler. The legs are removably attachable and the chute is configured to nest with other chutes.

13 Claims, 3 Drawing Sheets

SANDBAG FILLING TOOL

FIELD OF THE INVENTION

The following invention relates to tools for assisting in the filling of sandbags, such as sandbags utilized for flood mitigation and erosion control. More particularly, this invention relates to sandbag fillers which act to simplify the rapid introduction of sand from a pile on the ground into a sandbag, and especially with as few as a single person.

BACKGROUND OF THE INVENTION

When sandbags are to be filled various challenges are faced. First, time is typically of the essence and the quicker the sandbags can be filled the more effectively they can be utilized. Also, commonly the number of individuals available to assist in filing the sandbags is limited, and in some circumstances a shortage of shovels may exist.

Furthermore, the traditional method of loading a shovel with sand and then placing the blade of the shovel into the opening of the bag and then tilting the shovel to slide the sand into the bag is both time intensive and requires two users to have any significant process efficiency. If the individuals attempt to speed up the process, the individual holding the bag is susceptible to injury from the blade of the shovel.

In at least one prior art device taught by Donald J. Rooker (shown in U.S. Pat. No. 6,047,748, incorporated herein by reference in its entirety) a sandbag filling device is disclosed which addresses many of these challenges. A chute is provided which tapers as a funnel from a larger inlet to a smaller outlet. An additional sandbag is filled with sand and deployed from the funnel as ballast. Legs are provided to support the funnel above ground.

One drawback of the sandbag filling device taught by Donald J. Rooker is that it still requires two individuals for effective operation. One individual throws sand into the funnel, such as with a shovel. A second individual holds the sandbag adjacent the spout and is responsible for redeploying fresh sandbags as sandbags are filled. While this Donald J. Rooker device can rapidly and effectively fill sandbags when two individuals are available, a need exists for a similarly effective device which can still be rapidly and successfully utilized when a single individual is filling sandbags alone, or when one of the two individuals is often detained with other activities such as loading sandbags into vehicles or deploying sandbags in a water intrusion preclusion location.

SUMMARY OF THE INVENTION

With this invention a sandbag filler is disclosed which includes a chute having an inlet in the form of a mouth and an outlet in the form of a spout at opposite ends of the chute. A centerline extends from the mouth to the spout and a cross-sectional area of the chute perpendicular to the centerline is greater at the mouth than it is at the spout. Thus, a relatively large target is presented for the shoveling of sand, while a spout of sufficient smallness is presented for directing the sand into a sandbag.

A fastener is coupled to the chute which can grasp a portion of the sandbag when the sandbag is placed adjacent the spout. This fastener is most preferably generally in the form of a clip and preferably located on an upper surface of the chute between the mouth and the spout. In this configuration, the sandbag to be filled is automatically held adjacent the spout and ready to be filled without requiring the presence of an individual to hold the sandbag in place. The filler of this invention can thus be used by a single individual. If a second individual is available, this second individual can be busy moving filled sandbags or attaching and detaching sandbags from the fastener to make the sandbag filling and handling process as efficient as possible.

Preferably, the chute is supported upon a base which allows the connection of legs extending down from the base and supporting the entire chute above ground. The base and legs are also preferably configured so that a tilt angle is provided for a floor of the chute defining a lowermost portion of the chute as it extends between the mouth and the spout. This tilt angle is preferably sufficient that sand can flow under gravity forces alone from the mouth to the spout and prevent the chute from becoming clogged with trapped sand. Alternatively, the floor can be tilted a lesser amount and still provide some benefit in encouraging sand to travel from the mouth to the spout.

Because the chute and associated structures are beneficially made from lightweight materials to facilitate easy transfer from various locations, it is desirable to increase a weight of the chute so that flying sand or wind does not tend to knock over the chute and so that the chute can be generally stable even with as few as three legs. Ballast is thus provided by placing sand within a sandbag and deploying the sandbag from an eye bolt or other coupling suspended from the chute, such as through the base. Legs are preferably removably attachable to the base so that the entire structure can collapse somewhat. Multiple chutes can nest within each other partially so that storage of a large number of similar sandbag filling tools can occur in a small space.

OBJECTS OF THE INVENTION

Accordingly, a primary object of the present invention is to provide a device for enhancing the efficiency with which sand is loaded into a sandbag.

Another object of the present invention is to provide a sandbag filler which can be effectively utilized with as few as a single individual.

Another object of the present invention is to provide a sandbag filler which holds the sandbag in an open position automatically.

Another object of the present invention is to provide a sandbag filler which is lightweight for transport but accommodates ballast to make it difficult to topple from lateral loads caused by flying sand, wind or the like.

Another object of the present invention is to provide a sandbag filler which is collapsible to take up a minimum amount of space when being stored.

Another object of the present invention is to provide a sandbag filler which can be nested with other sandbag fillers when not in use to minimize storage space required.

Another object of the present invention is to provide a sandbag filler which can maximize a rapidity with which sandbags can be filled and minimize an amount of physical exertion required to fill the sandbags.

Another object of the present invention is to provide a sandbag filler which is complemental to commonly available tools such as shovels and is simple to use without requiring any instruction or training in the use thereof.

Other further objects of the present invention will become apparent from a careful reading of the included drawing figures, the claims and detailed description of the invention.

DESCRIPTION OF THE PREFERRED EMBODIMENT

Figure 1:
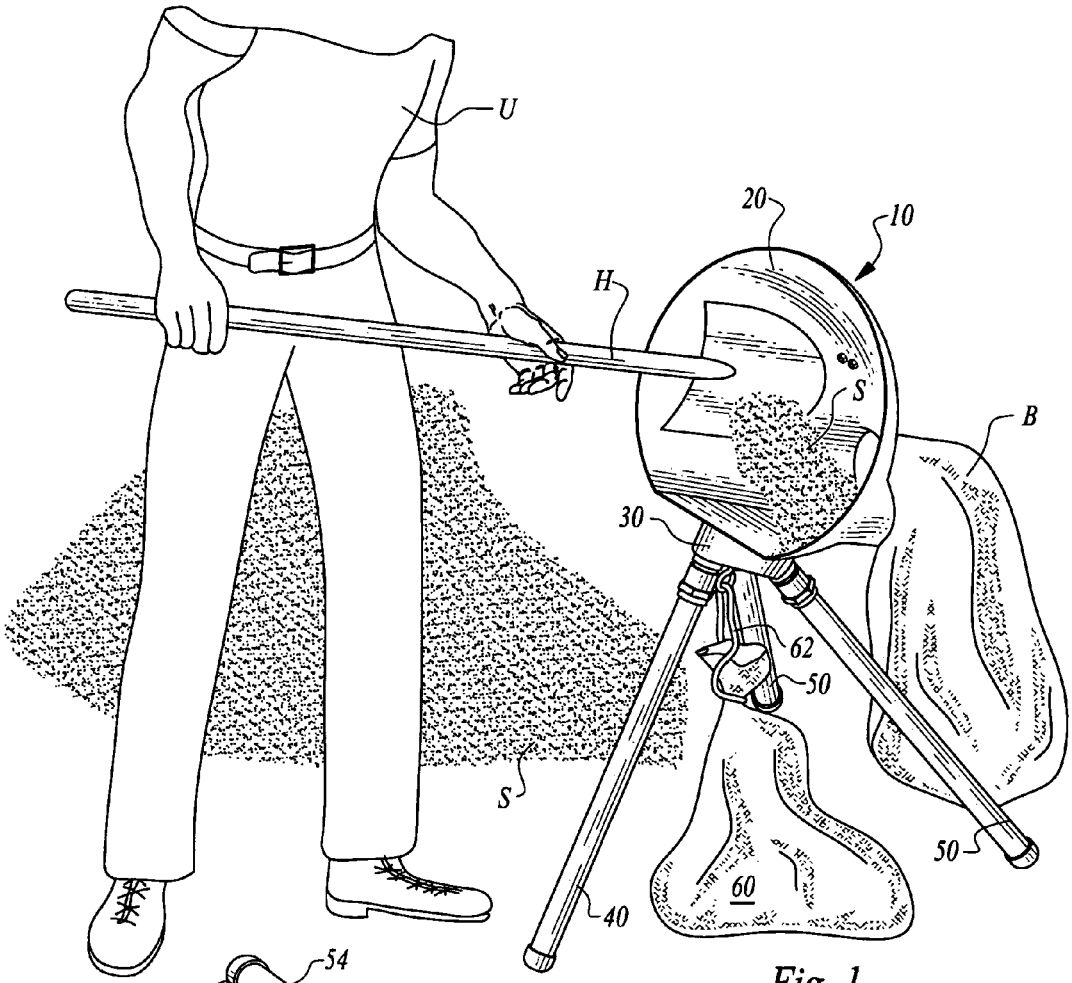
FIG. 1 is a perspective view of the sandbag filling tool of this invention in use filling a sandbag with sand.
Figure 2:
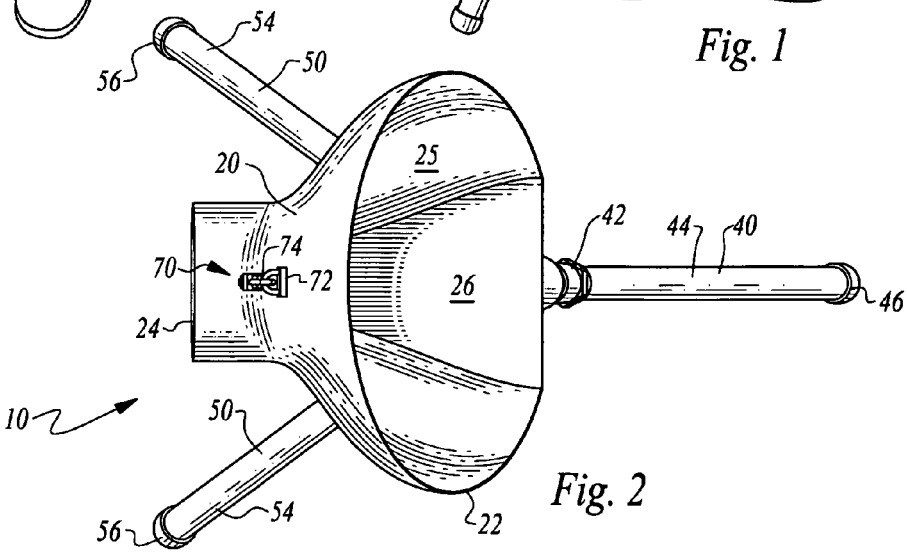
FIG. 2 is a top plan view of the sandbag filling tool of this invention.

Referring to the drawings, wherein like reference numerals represent like parts throughout the various drawing figures, reference numeral 10 is directed to a filler, providing the preferred embodiment for this invention. The filler 10 assists a user U in delivering sand S from a sandpile into a bag B for rapid and effective loading of sandbags. The filler 10 facilitates easy and rapid loading of the bag B with sand S and allows a single user U to utilize the filler 10 without assistance or to make more efficient the loading and placement of sandbags when multiple individuals are available.

In essence, and with particular reference to FIG. 1, basic details of the filler 10 are described, according to a preferred embodiment. The filler 10 includes a chute 20 which generally acts as a funnel with a mouth 22 acting as an inlet on one side of the chute 20 and a spout 24 (FIGS. 3 and 4) acting as an outlet for the sand S and smaller than the mouth 22. A base 30 is preferably secured to a floor 26 (FIG. 4) of the chute 20. A plurality of legs 40, 50 attach to the chute 20, preferably through the base 30. These legs 40, 50 are removably attachable to facilitate collapsing of the filler 10 when not in use.

A ballast bag 60 is provided, preferably suspended from the base 30 and filled with sand S, to decrease any tendency for the filler 10 to topple over when experiencing lateral loads, such as wind loads or loads associated with a shovel H banging the filler 10 or loads associated with the tossing of sand S by the user U against the filler 10. A clip 70 is coupled to the chute 20 and can hold a portion of the bag B adjacent the spout 24 of the chute 20. The clip 70 thus holds the bag B adjacent the chute 20, with the bag B open, while the user U loads sand S through the chute 20 and into the bag B.

More specifically, and with particular reference to FIGS. 1-4, details of the chute 20 are described, according to a preferred embodiment. The chute 20 is preferably a monolithic structure with a hollow interior and an open inlet defined by a mouth 22 and an open outlet defined by a spout 24. A centerline generally passes through both the mouth 22 and spout 24. The chute 20 is configured so that the mouth 22 has a greater diameter than the spout 24. In particular, the mouth 22 is significantly larger than a typical blade of a shovel H. Thus, a large target is provided for the user U when throwing sand S into the mouth 22 of the chute 20. The spout 24, in contrast, is sufficiently small so that an entrance of a bag B can be easily placed over the spout 24 or other outlet. The spout 24 also is preferably formed to be shorter above said centerline and larger below said centerline and along said floor 26. Such a form assists the sand S in making its way fully into the sand bag B. This plane of truncation of the spout 24 is preferably vertical.

As shown in the figures, the chute 20 preferably exhibits a somewhat irregular shape as the circumference and cross-sectional area of the chute 20 decreases along the centerline moving from the mouth 22 to the spout 24. Most preferably, the mouth 22 defines a largest cross-sectional area portion of the chute 20 with the spout 24 defining a smallest cross-sectional area portion of the chute 20.

A floor 26 preferably is substantially planar and also extends from the mouth 22 to the spout 24. This floor 26 generally defines a lowest portion of the chute 20 below the centerline and between the mouth 22 and the spout 24. This floor 26 preferably has a tilt angle which is approximately 30° from horizontal. Such a tilt angle makes it difficult for sand S to rest upon the floor 26. Rather, sand S is encouraged by gravity to fall down the floor 26 and pass from the mouth 22 toward the spout 24. Depending on the sand S character and other forces, the sand S preferably slides along the floor 26 under gravity loads alone.

A funnel wall 25 defines the structure of the chute 20 as it encloses the pathway from the mouth 22 to the spout 24. This funnel wall 25 is preferably of substantially constant thickness. The funnel wall 25 also beneficially also has a bright color for ease in identifying the filler 10. The funnel wall 25 has a tapering form which is preferably irregular as shown in the drawings figures. However, this tapering cross-sectional area preferably is continuous from the mouth 22 to the spout 24 (albeit at different rates of area decrease) so that the chute 20 can nest with other chutes 20 having a similar form. A compact set of fillers 10 can thus be stored in a small volume storage area when the legs 40, 50 have been removed.

The funnel wall 25 is preferably formed from an injection moldable plastic having the contour shown. As an alternative, the chute 20 could be formed from fiberglass or from other composite materials, such as carbon fiber material. The chute 20 could also conceivably be formed of aluminum or other metals. While the chute 20 is shown with a particular configuration, the chute 20 could have a variety of different shapes and sizes and still provide the general function of providing a pathway for sand S from a large target area in the form of the mouth 22 to a smaller spout 24 small enough to fit inside the opening of the bag B for delivery of sand S into the bag B.

Figure 7:
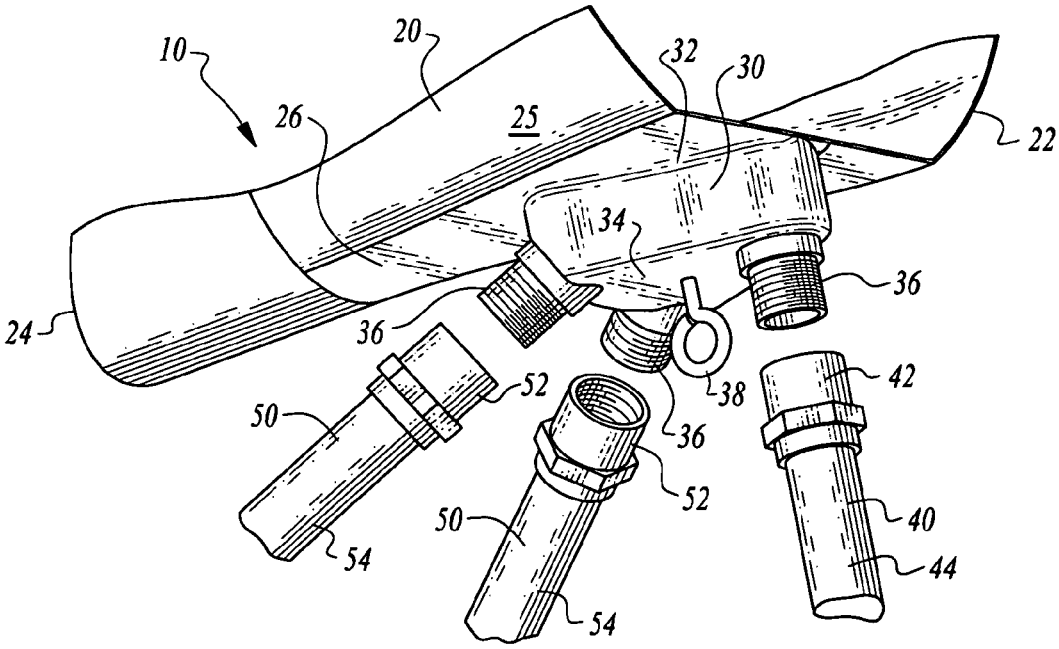
FIG. 7 is a detail of a base which interconnects a chute of the sandbag filling tool with legs of the sandbag filling tool and illustrating how the legs can be removably attached to the chute.

A base 30 is preferably provided coupled to a lower side of the floor 26 of the chute 20. This base 30 provides a structure from which the legs 40, 50 can be suspended, as well as a location where the ballast bag 60 can be coupled to decrease any tendency for the filler 10 to be toppled. This base 30 is preferably a rigid unitary mass of material, such as injection molded material, and is best shown in FIG. 7. The base 30 includes a top wall 32 coupled to the floor 26 of the chute 20, such as through use of an adhesive or through appropriate fasteners. It is also conceivable that the base 30 could be formed with the chute 20 during an injection molding process or through whatever manufacturing process is utilized to form the chute 20.

A bottom wall 34 is provided opposite the top wall 32. The bottom wall 34 preferably includes threaded posts 36 extending therefrom as well as an eye bolt 38. The eye bolt 38 provides a coupling to which a rope 62 can be attached. An opposite end of the rope 62 can close an opening in a ballast bag 60 so that the ballast bag 60 is suspended directly below the base 30 and thus directly below the chute 20 of the filler 10 (and down to the ground most preferably). The ballast bag 60 is preferably identical to the bags B which are to be filled by the filler 10. The ballast bag 60 is preferably filled with sand, but could alternatively be filled with rocks or other weights.

With continuing reference to FIGS. 1-4 and also FIG. 7, particular details of the legs 40, 50 are described. Legs 40, 50 provide a preferred form of means to suspend the chute 20 of the filler 10 above ground to present the most convenient target for sand S from a shovel H handled by a user U. Most preferably, three legs 40, 50 are provided including a front leg 40 and a pair of rear legs 50. As sand throwing loads are directed rearwardly, the two rear legs 50 are presented to absorb any such loads. While the legs 40, 50 could be of different lengths, most preferably each of the legs 40, 50 is provided with a similar length to facilitate interchangeability.

The front leg 40 includes a top coupling 42 which is complemental with threaded posts 36 on a forward most portion of the base 30. Thus, the top coupling 42 of the front leg 40 can be threaded onto the threaded post 36 of the base 30 on a forward portion of the base 30. The front leg 40 further includes a shaft 44 extending down from the top coupling 42 and terminating at a foot 46 opposite the top coupling 42. The foot 46 preferably includes a high friction cap which helps to keep the chute 20 from sliding when placed upon a slick surface. Such feet 46 also tend to protect any fragile or valuable surfaces upon which the filler 10 is being utilized.

The rear legs 50 are similar to the front leg 40 in that they include top couplings 52 removably attachable to the threaded posts 36 oriented more rearwardly on the base 30. The rear legs 50 also include shafts 54 extending down to feet 56 in a fashion similar to the front leg 40.

Figures 3, 4:
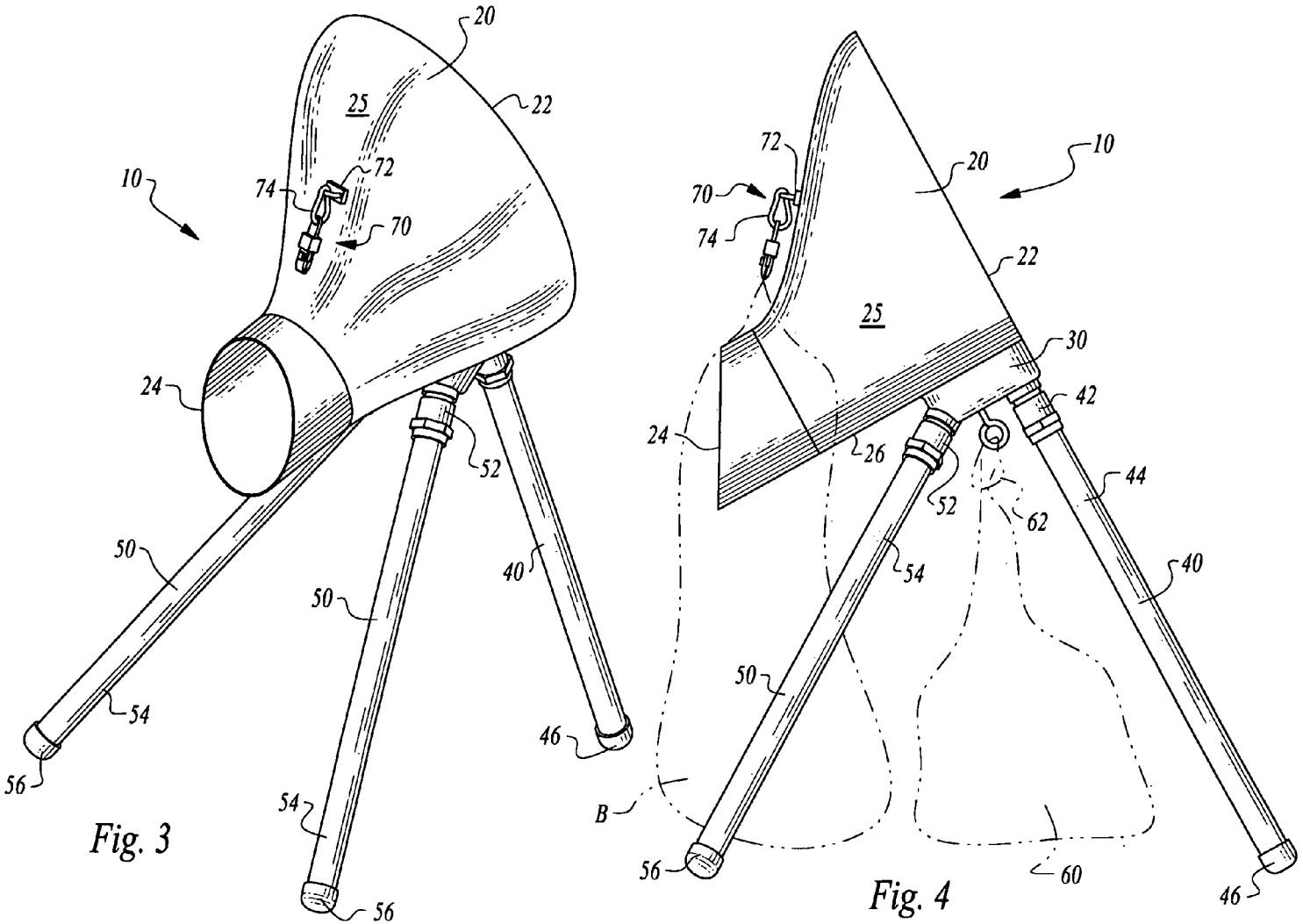
FIG. 3 is a perspective view of the sandbag filling tool alone.
FIG. 4 is a side elevation view of the sandbag filling tool of this invention and with a sandbag being filled shown in phantom and with a sandbag utilized as ballast shown in phantom adjacent the sandbag filling tool of this invention.
Figure 5:
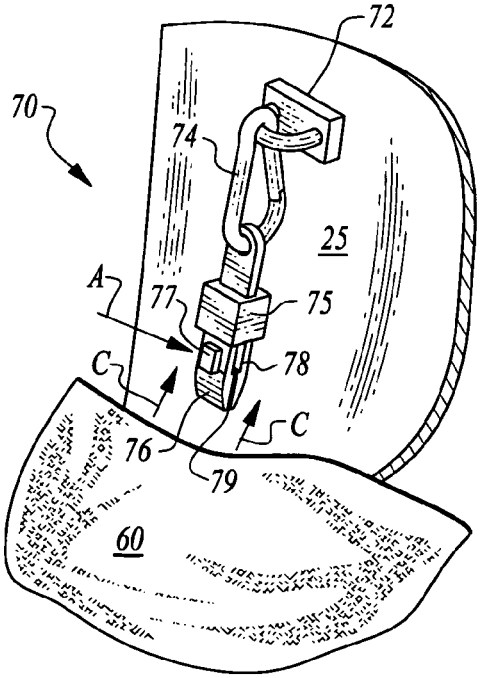
FIG. 5 is a detail of a fastener of this invention which is capable of temporarily holding a sandbag to be filled adjacent a spout of the sandbag filling tool.
Figure 6:
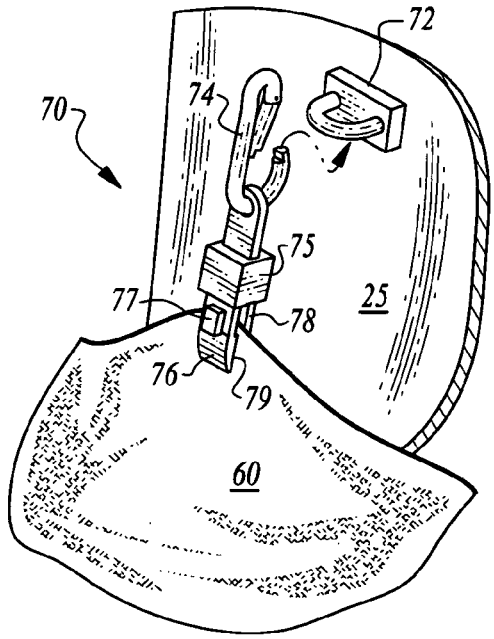
FIG. 6 is a detail similar to that shown in FIG. 5 and illustrating how the fastener can be removably attached to the chute of the sandbag filling tool.

The threaded posts 36 of the base 30 generally define an orientation for the legs 40, 50. In particular, the plurality of threaded posts 36 preferably include three such threaded posts 36 with one of the threaded posts 36 extending forwardly and downwardly at approximately a 60° angle to horizontal (FIG. 4). The rear legs 50 have their orientation established by the two threaded posts 36 of the base 30 oriented more rearwardly on the base 30. Most preferably, these rear legs 50 angle rearwardly at an angle of approximately 60° away from horizontal and away from each other with approximately 60° between each of the two rear legs 50.

The shafts 44, 54 of the legs 40, 50 are preferably linear and formed of hollow tubing to minimize weight and maximize strength. Most preferably, these shafts 44 are formed of a plastic material such as polyvinyl chloride ("PVC"). The legs 40, 50 can optionally be made to telescope and exhibit adjustable length. However, most preferably the legs 40, 50 benefit from being of a single non-adjustable length, with the mouth 22 of the chute 20 sufficiently large to accommodate users U having different heights, even when the legs 40, 50 maintain a constant length.

The legs 40, 50 are preferably configured to be readily removably attached from the threaded posts 36 on the base 30. Thus, when the chute 20 is to be stored in a small area, the legs 40, 50 can be removed. Once removed, the chute 20 and associated base 30 can be nested within another chute 20 and base 30 assembly to some degree, to facilitate low volume in shipping of one or more fillers 10 and decreasing an amount of storage space required when the fillers 10 are being stored.

With particular reference to FIGS. 1 and 4, details of the ballast bag 60 are described. The ballast bag 60 is preferably similar to the bag B in which sand S is being provided for filling. However, this ballast bag 60 is not utilized in the flood control efforts, but rather is tied to the chute 20, such as through the eye bolt 38 or other coupling in the base 30, with a length of rope 62 or other line. This rope 62 can also close off the ballast bag 60 so that sand S does not escape from the ballast bag 60. The eye bolt 38 provides a preferred form of line accepting coupler. While the ballast bag 60 could be a dedicated structure that can be reused for ballast, most preferably after utilization of the filler 10, the ballast bag 60 is removed and utilized along with the other sandbags. When the filler 10 is to be reused, the first bag B filled is used as the new ballast bag 60.

With particular reference to FIGS. 3-6, details of a clip 70 providing a preferred form of fastener for holding the bag B adjacent the spout 24 of the chute 20, are described according to a preferred embodiment. The filler 10 includes a fastener for holding the bag B with an opening of the bag B overlapping the spout 24 of the chute 20. This fastener is preferably provided in the preferred form of the clip 70. This clip 70 is of a type which can readily and securely grip planar sheet material, such as that forming a sandbag B, and have sufficient holding force that the bag B does not fall off of the clip 70 or other fastener before the bag B has been completely filled.

Most preferably, this clip 70 is mounted to the chute 20 in a location directly above a centerline of the chute 20 and approximately midway between the mouth 22 and the spout 24. For instance, the chute 20 can be fitted with a U-bolt 72 and a carabener 74 can then be removably secured to the U-bolt 72. The clip 70 is attached to the carabener 74. Alternatively, the clip 70 could be coupled directly to the U-bolt 72 or otherwise directly attached to the chute 20.

The clip 70 itself most preferably includes a top jaw 76 substantially parallel with a bottom jaw 78. The junction 75 also joins the jaws 76, 78 together and preferably provides some form of resilient force applying structure, tending to draw the jaws 76, 78 toward each other. A junction 75 defines a transition from a portion of the clip 70 configured to be coupled to the carabener 74 and the location where the jaws 76, 78 extend from the clip 70.

A button 77 is preferably provided upon the clip 70 which urges the jaws 76, 78 away from each other, and facilitating release of the bag B, such as when the bag B has been satisfactorily filled, by pushing the button 77. A gap 79 is provided between the jaws 76, 78 which has essentially zero size when the jaws 76, 78 are allowed to close against each other. However, the gap 79 appears and grows when the jaws 76, 78 are pushed away from each other. This gap 79 defines an area where a portion of the bag B adjacent an opening thereof can be placed so that the entire bag B is secured in a manner suspended from the clip 70 or other fastener and from the chute 20, while overlying the spout 24 (FIG. 4).

While the fastener in this example is preferably in the form of a clip 70, various other fasteners could be utilized for the securing of the bags B to the chute 20 in a position overlying the spout 24. For instance, the fastener could be in the form of adhesive tape, a pin structure, such as a safety pin or other needle pin threaded through the fabric of the bag B, a button cooperating with a buttonhole in the sandbags, complemental snaps included on the fastener 70 and on the bag B, complemental velcro formed on the bag B and as at least a portion of the fastener, and a variety of other fasteners.

In use and operation, and with particular reference to FIG. 1, details of the manner in which the filler 10 is utilized are described. Initially, the filler 10 is set up for utilization. The legs 40, 50 are threaded onto the threaded posts 36 of the base 30 so that the chute 20 is deployed. The base 30 is constructed so that the chute 20 automatically has the desired angle for the floor 26 once the legs 40, 50 have been attached to the threaded posts 36 of the base 30. A ballast bag 60 is then selected and loaded with sand. A rope 36 is utilized to close off the ballast bag 60 and tie it to the eye bolt 38 of the base 30. The chute 20 is thus now exceptionally stable, even though it only has three legs.

The user U then takes a bag B and places an opening of the bag B over the spout 24 of the chute 20. A portion of the bag B adjacent the opening thereof is inserted between the jaws 76, 78 of the clip 70 or otherwise coupled to the fastener, so that the bag B is held over the spout 24 and ready to receive sand S. A user U then delivers sand S to the bag B through the filler 10. In particular, the user U would typically utilize a shovel H, loading a blade of the shovel H with sand S. This sand S is then deposited into the mouth 22 of the chute 20. The sand S migrates down the chute 20 and over the floor 26 along the centerline, until the sand S reaches the spout 24. The sand S then falls out of the chute 20 and into the bag B.

When the bag B is sufficiently full, the bag B can be easily removed from the fastener by merely tugging on the bag B or pushing the button 77 (FIGS. 5 and 6) to cause the jaws 76, 78 to release the bag B. Once the bag B has been filled, the bag B is removed from the fastener, such as the clip 70, and taken off of the spout 24. The sandbag B is now ready for use. An empty sandbag B is then placed over the spout 24, coupled to the clip 70 or other fastener, and the process is repeated for a new sandbag B.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A sandbag filling assistance tool, the tool comprising in combination:

a chute having an inlet spaced from an outlet and with a centerline of the chute extending through both the inlet and the outlet;

said inlet having an area perpendicular to said centerline which is greater than an area of said outlet perpendicular to said centerline;

a plurality of legs coupled to said chute and adapted to locate said chute above ground;

a fastener coupled to said chute, said fastener adapted to hold a sandbag with an opening into the sandbag oriented adjacent said outlet of said chute;

wherein said fastener includes a clip with at least two jaws capable of relative motion therebetween, said at least two jaws having a gap therebetween sized sufficiently large to receive a portion of a sandbag therein, and with said jaws adapted to grasp the sandbag when the sandbag is placed between said jaws;

wherein said fastener is located on a portion of said chute between said inlet and said outlet and above a highest portion of said outlet;

wherein said at least two jaws include a top jaw and a bottom jaw, each said jaw coupled together at a junction at upper ends of said top jaw and said bottom jaw, said junction including a resilient force applying structure adapted to draw said top jaw and said bottom jaw toward each other;

wherein a button is provided upon said clip, said button adapted to move said jaws away from each other and open said gap between said jaws when said button is pushed; and wherein a U-bolt is fixed to said chute on a portion of said chute between said inlet and said outlet and on an exterior surface of said chute and above a highest portion of said outlet, said U-bolt adapted to have said clip coupled thereto.

2. The tool of claim 1 wherein a base is oriented between said chute and said plurality of legs.

3. The tool of claim 1 wherein said plurality of legs includes at least three legs with upper ends of said legs coupled to said chute, said legs located closer to each other at said upper ends of said legs than at lower ends of said legs.

4. The tool of claim 3 wherein at least one of said legs is of adjustable length.

5. The tool of claim 3 wherein said at least three legs are each removable from said chute, such that collapsibility of the tool for storage is facilitated.

6. The tool of claim 1 wherein a ballast weight is coupled to said chute and adapted to extend down from said chute at a location at least partially between said plurality of legs, said ballast adapted to decrease a tendency of said chute to move when impacted by lateral loads.

7. The tool of claim 6 wherein said ballast includes a sandbag having a thin walled flexible sand containing enclosure with an opening through which sand can be introduced, said sandbag filled with sand and with a line both at least partially closing said opening of said bag and tying said bag to a line accepting coupler, said line accepting coupler itself coupled to said chute.

8. The tool of claim 1 wherein said outlet is configured as a spout with a lowermost portion of said spout extending further along said centerline than an upper portion of said spout, said spout having a cross-sectional area less than a cross-sectional area of an opening of a sandbag, such that the opening of the sandbag can be placed entirely over said spout when coupled to said fastener.

9. A single person capable sandbag filler, comprising in combination:

a chute having an inlet spaced from an outlet and with a centerline of the chute extending through both the inlet and the outlet;

said inlet having an area perpendicular to said centerline which is greater than an area of said outlet perpendicular to said centerline;

a fastener coupled to said chute, said fastener adapted to hold a sandbag with an opening into the sandbag oriented adjacent said outlet of said chute;

wherein said fastener includes a clip with at least two jaws capable of relative motion therebetween, said at least two jaws having a gap therebetween sized sufficiently large to receive a portion of a sandbag therein, and with said jaws adapted to grasp the sandbag when the sandbag is placed between said jaws;

wherein said fastener is located on a portion of said chute between said inlet and said outlet and above a highest portion of said outlet;

wherein said at least two jaws include a top jaw and a bottom jaw, each said jaw coupled together at a junction at upper ends of said top jaw and said bottom jaw, said junction including a resilient force applying structure adapted to draw said top jaw and said bottom jaw toward each other;

wherein a button is provided upon said clip, said button adapted to move said jaws away from each other and open said gap between said jaws when said button is pushed; and wherein a U-bolt is fixed to said chute on a portion of said chute between said inlet and said outlet and on an exterior surface of said chute and above a highest portion of said outlet, said U-bolt adapted to have said clip coupled thereto.

10. The filler of claim 9 wherein said filler includes a means to support said chute above ground.

11. The filler of claim 9 wherein said chute has a floor defining a lowermost portion of said chute extending between said inlet and said outlet, said floor having a tilt angle sufficient to allow sand to slide under gravity forces alone from said inlet to said outlet.

12. The filler of claim 9 wherein said fastener is located on a portion of said chute between said inlet and said outlet and above a highest portion of said outlet; and wherein said outlet is configured as a spout with a lowermost portion of said spout extending further along said centerline than an upper portion of said spout, said spout having a cross-sectional area less than a cross-sectional area of an opening of a sandbag, such that the opening of the sandbag can be placed entirely over the spout when coupled to said fastener.

13. The filler of claim 9 wherein a ballast weight is coupled to said chute and adapted to extend down from said chute at a location at least partially between said plurality of legs, said ballast adapted to decrease a tendency of said chute to move when impacted by lateral loads.

* * * * *